US006230950B1

(12) United States Patent
Heetman

(10) Patent No.: US 6,230,950 B1
(45) Date of Patent: May 15, 2001

(54) ROLL-UP CARRY BAG

(75) Inventor: Joris J. G. Heetman, Amsterdam (NL)

(73) Assignee: Joost Heetman Industrial Design, Amsterdam (NL)

( * ) Notice: Subject to any disclaimer, the term of this patent is extended or adjusted under 35 U.S.C. 154(b) by 0 days.

(21) Appl. No.: 09/348,691

(22) Filed: Jul. 7, 1999

(30) Foreign Application Priority Data

Jul. 7, 1998 (BX) ..... 74656-01
Jul. 7, 1998 (BX) ..... 74656-02

(51) Int. Cl.[7] ..... A45F 4/00

(52) U.S. Cl. ..... 224/575; 224/153; 224/586; 224/901.2; 224/901.6; 206/287.1; 190/107; 383/4

(58) Field of Search ..... 224/575, 577, 224/153, 586, 901.2, 901.6; 206/287.1; 190/107; 383/4

(56) References Cited

U.S. PATENT DOCUMENTS 2,871,900 * 2/1959 Auditore ..... 383/4 X
4,078,264 * 3/1978 DeGennaro et al. ..... 383/4 X
4,404,687 * 9/1983 Hager ..... 383/4 X
4,423,834 * 1/1984 Rush ..... 224/153
5,287,571 * 2/1994 Rademacher ..... 383/4 X
5,346,308 * 9/1994 Buchot et al. ..... 383/4
5,797,529 * 8/1998 Lavine ..... 224/575
5,996,121 * 12/1999 Harris ..... 224/577 X
6,061,849 * 5/2000 Seals ..... 383/4 X

* cited by examiner

*Primary Examiner*—Stephen K. Cronin
(74) *Attorney, Agent, or Firm*—Greer, Burns & Crain, Ltd

(57) ABSTRACT

A carry container constructed and adapted to be rolled-up into a compact generally cylindrical shape includes a bag and a wrapping band having a front face, a back face, a fixed end and a free end. The back face proximate the fixed end is attached to a back and near a top of the bag. A fastening device is attached to the front face proximate the fixed end and to the back face proximate the free end for releasably fastening the free end to the fixed end after wrapping, around the bag when the bag has been folded and rolled-up.

17 Claims, 3 Drawing Sheets

ROLL-UP CARRY BAG

BACKGROUND OF THE INVENTION

This invention generally relates to carry bags, and specifically to a carry bag which is adapted to be rolled-up into a compact generally cylindrical form.

Many carry bags such as shoulder bags and backpacks which do not have a rigid frame are on the market today. They are relatively inexpensive, and can also be conveniently folded or rolled-up for ease of carriage and storage when not in use. These conventional bags, however, tend to unfold or unroll when folded or rolled-up if they are not tied up. Often, the shoulder straps attached to the bags themselves or separate straps or cords, for example, are employed in keeping the bags folded or rolled-up. Using the shoulder straps, however, makes the folded or rolled-up bags bulky and unsightly and the separate straps or the cords can become lost.

Also, it is desirable to provide low cost merchandise for premium or private label advertising specialty purposes. Such products typically feature flat panel areas for imprinting brand names, slogans or logos.

Thus, it is a first object of the present invention to provide an improved carry bag which can be rolled-up into a compact cylindrical form.

It is another object of the present invention to provide an improved carry bag which has a wrapping band attached to the bag for keeping the bag neatly rolled-up.

It is a further object of the present invention to provide an improved carry bag which, when rolled up, provides a panel area suitable for receiving printing.

BRIEF SUMMARY OF THE INVENTION

The above-identified objects are met or exceeded by the present carry container, such as a backpack or a shoulder bag which is adapted to be rolled-up into a compact cylindrical form for ease of carriage and storage. A wrapping band maintains the backpack or the shoulder bag in the cylindrical form. It has a front face that becomes the side of the formed cylinder when the backpack or the shoulder bag is rolled-up. Logos and/or text can be printed on the front face so that the rolled-up backpack or the shoulder bag resembles a cylinder shaped product, for example, beer or soda cans, a drinking glass, or a battery.

More specifically, the present invention is directed to a carry container constructed and adapted to be rolled-up into a compact, generally cylindrical shape. The container includes a bag and a wrapping band having a front face, a back face, a fixed end and a free end. The back face of the band proximate the fixed end is attached to one of a back and a front of the bag. A fastening device is attached to the band for releasably fastening the free end to the fixed end after wrapping around the bag when the bag has been rolled-up.

DETAILED DESCRIPTION OF THE INVENTION

Figure 1:
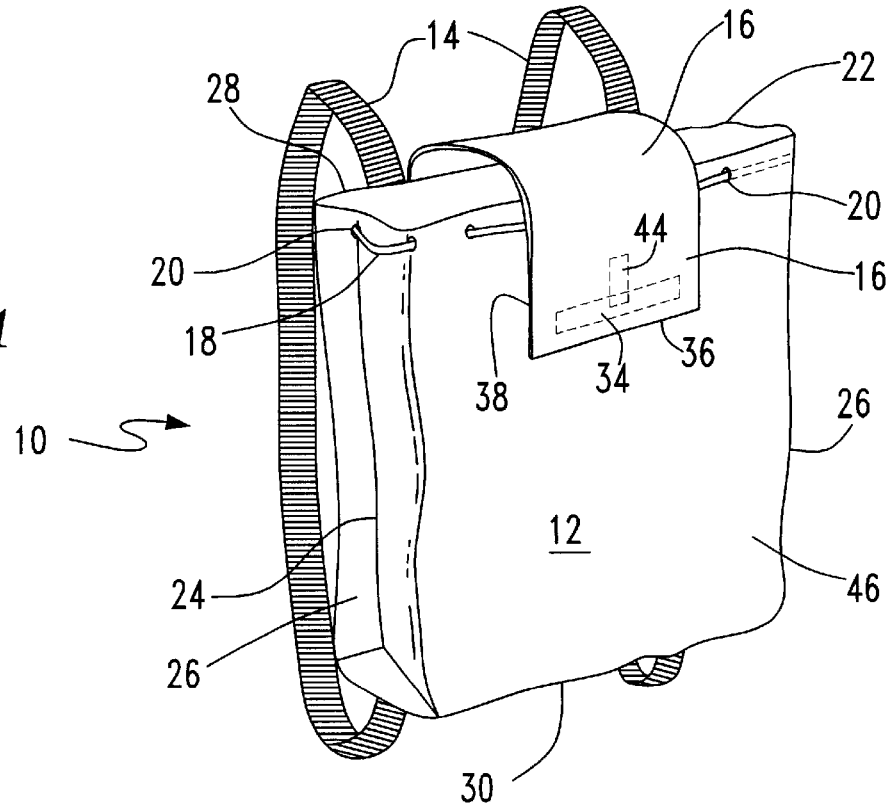
FIG. 1 is a perspective view of a backpack type carry bag embodying the present invention.

Referring to FIG. 1, a container such as a backpack in accordance with the present invention is shown and generally designated 10. The backpack 10 is provided with a bag 12, at least a pair of shoulder straps 14 and at least one wrapping band 16.

The bag 12 preferably includes a drawstring 18 which is looped in and out through a number of eyelets 20 located near a top 22 of the bag to facilitate the retention of the contents of the bag. A gusset 24 is preferably provided on each side 26 of the bag 12 (only shown on one side) to allow the bag to be expanded and folded as necessary. It should be noted that the bag 12 does not have a rigid frame so that it can be folded and rolled-up for storage. The material for the bag 12 in the preferred embodiment is a 420D Nylon type material with PVC backing. However, the bag can also be made from any relatively strong flexible or textile material which can be folded, for example, canvas, denim, duck or equivalent materials. Water repellant or resistant fabrics are also contemplated.

Each strap 14 is attached to a back 28 of the bag 12 near each side 26, with one end of the strap being attached near the top 22 and the other end near a bottom 30 of the bag. It will be appreciated that the number, size and placement of the straps 14 on the bag 12 may vary to suit the application.

The wrapping band 16 at a fixed end 32 (best shown hidden in FIG. 2) is attached to the back 28 of the bag 12. In the preferred embodiment, the band 16 is sewn onto the bag 12. However, other known fastening devices are contemplated, for example, adhesives or rivets. The width of the band 16 is approximately at least one third of the width of the bag 12, and the length is such that it sufficiently encircles the bag after the bag has been rolled-up (as will be shown below in FIGS. 2–6). Thus, the actual dimensions of the band 16 depend on the size and the material of the bag 12. Also, multiple bands 16 are contemplated provided they substantially enclose the folded and rolled up bag 12 as discussed below.

A hook portion 34 (shown hidden) of a hook and loop type fastener sold under the trademark VELCRO® is preferably provided proximate a free end 36 and on a back face 38 of the band 16, and a loop portion 40 of the VELCRO® fastener (best shown in FIG. 5) is preferably provided proximate the fixed end 32 on a front face 42 of the band. In this manner, the hook and loop portions 34, 40 are allowed to engage each other when the band 16 is looped around to overlap the fixed and free ends 32, 36. The backpack 10 is also provided with a loop portion 44 (best shown in FIG. 2) fixed to a front 46 of the bag 12. In operation, the hook portion 34 of the band 16 engages the loop portion 44, so that the band 16 acts as a cover for the otherwise open top 22 of the backpack 10. It will be appreciated that the hook and loop portions 34, 40 may be reversed if desired without reducing the performance of the backpack 10.

Referring now to FIGS. 2–6, the manner in which the backpack 10 is rolled-up into a compact, generally cylindrical shape is shown. First, the bag 12 is folded flat at the gussets 24 (best shown in FIG. 2). Then, left and right wing portions 48, 50 of the bag 12 (best shown in FIG. 3), which are located respectively to the left and right of left and right edges 52, 54 of the band 16, are folded inwardly in the directions indicated by arrows 56, 58, respectively. Preferably, the band 16 is generally centered between the two sides 26 of the bag 12, so that the left and the right wings 48, 50 overlap generally in an area on the bag defined by the left and the right edges 52, 54 of the band (best shown in FIG. 3). Because the straps 14 are attached to the back 28 preferably near the sides 26 of the bag 12, they are automatically positioned between the area on tie bag defined by the left and the right edges 52, 54 of the band 16 when the left and the right wings 48, 50 are folded (best shown in FIG. 3).

Figure 4:
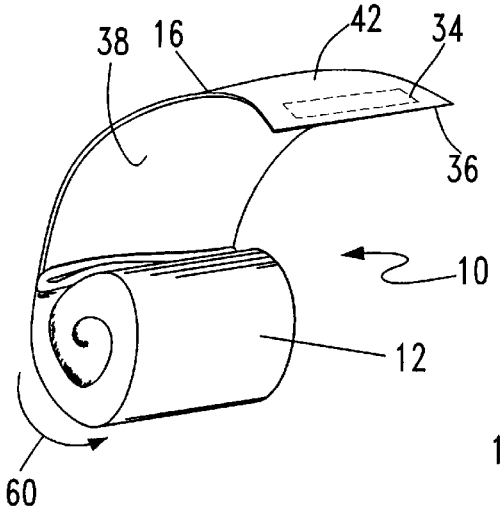
Figure 5:
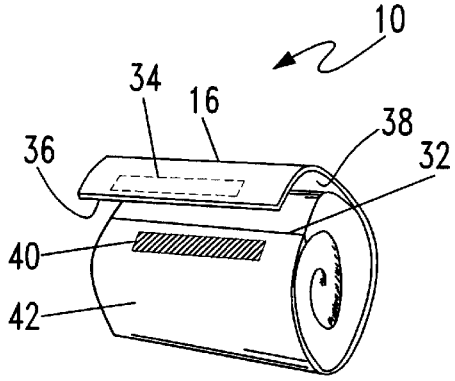
Figure 6:
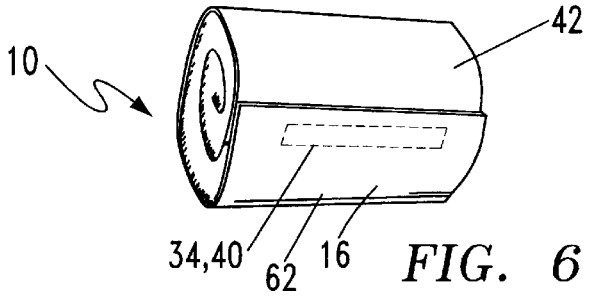

After the bag 12 is folded as described above, it is rolled-up from the bottom 30 of the bag towards the top 22 of the bag and back face 38 of the band 16, as shown by a direction arrow 60 in FIG. 4. Then, the band 16 is wrapped around the rolled-up bag 12 so that the hook and the loop portions 34, 40 are in position to engage each other (best shown in FIG. 5). Once the hook and the loop portions 34, 40 engage, the roll-up process is completed and the backpack 10 is rolled-up into a compact cylindrical shape, with the front face 42 of the band 16 now defining a side 62 of the rolled-up backpack. In the folded and rolled-up condition, the band 16 substantially covers the rolled up bag 12 and the straps 14. The side 62 is adapted to have logos and/or text printed thereon so that the backpack 10 can resemble any cylindrical products including but not limited to as beer cans, soda cans, soup cans and batteries.

Figure 7:
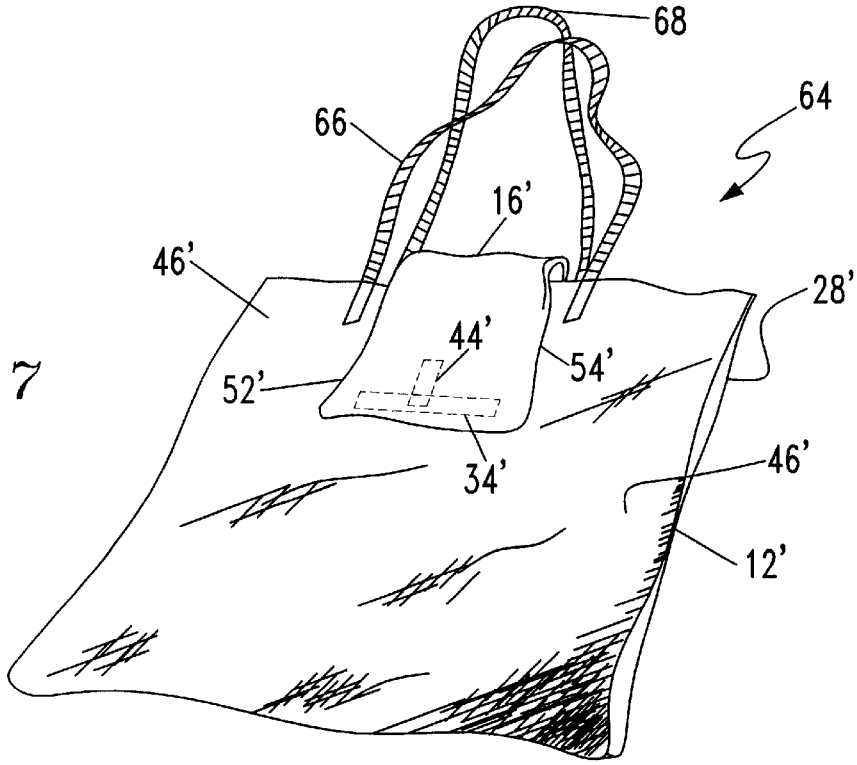
FIG. 7 is a perspective view of a shoulder bag-type carry bag embodying the present invention.

Turning now to FIG. 7, a container in the form of a shoulder bag or shopping bag in accordance with another embodiment of the present invention is shown and generally designated 64. The process in which the shoulder bag 64 is rolled-up into a compact cylinder is generally the same as the process described above with respect to the backpack 10. Therefore, only those features of the shoulder bag 64 which are distinguishable from that of the backpack 10 will be described below, and similar features will be referenced with like numbers.

The shoulder bag 64 includes a front strap 66 attached to the front 46' of the bag 12', with the two ends of the strap 66 being respectively attached to the left and the right of the left and the right edges 52', 54' of the wrapping band 16'. A back strap 68 is attached to the back 28' of the bag 12', its ends also respectively attached to the left and the right of the left and the right edges 52', 54'. The material for the bag 12' in the preferred embodiment is also a 420D Nylon type material with PVC backing for a relatively large bag, and a 190T Nylon type material for a relatively small bag. However, like the bag 12, the bag 12' can also be made from any relatively strong flexible or textile material which can be folded, for example, canvas or denim.

Figure 2:
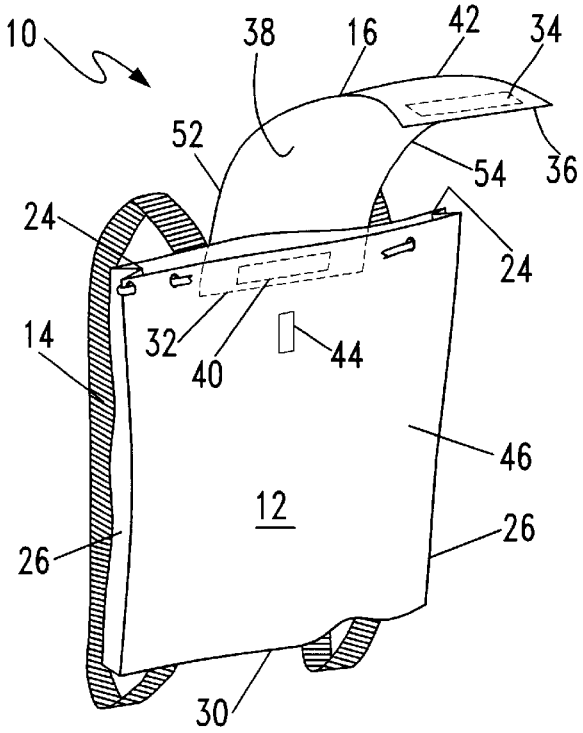
FIGS. 2–6 are perspective views of the bag of FIG. 1, showing the sequential folding operation of the present invention at various stages.
Figure 3:
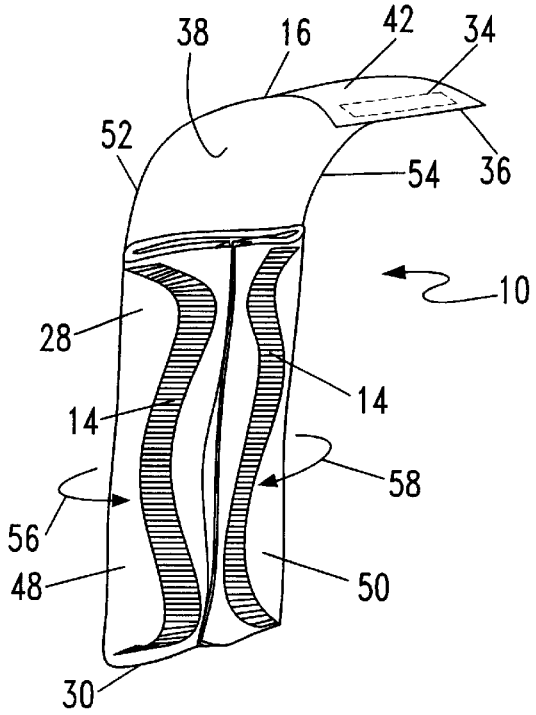
Figure 8:
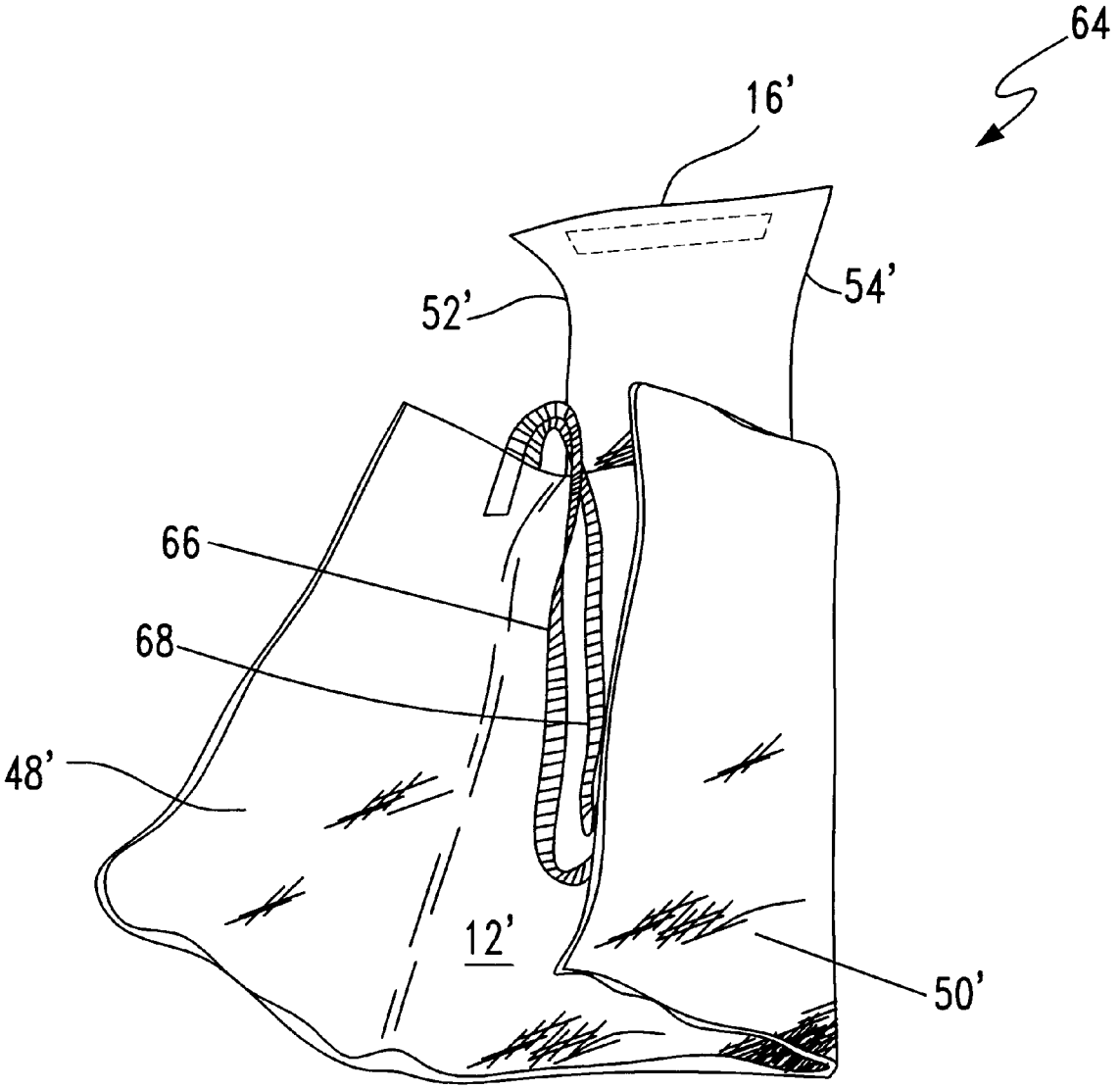
FIG. 8 is a perspective view of the bag of FIG. 7 showing one stage of operation of the present invention.

The manner in which a wrapping band 16' is attached to the shoulder bag 64 is similar to way the band 16 is attached to the backpack 10 (best seen in FIG. 2). Also, the method of having the shoulder bag 64 rolled-up is also similar to that of the backpack 10 (best shown in FIGS. 2–6). With respect to the shoulder bag 64, however, the shoulder straps 66, 68 are preferably be placed on the front 46' of bag before the bag 12' is rolled-up (best shown in FIG. 8), since these straps are not placed there automatically when the wing portions 48', 50' are folded, as with the backpack 10. Alternatively, the straps 66, 68 may be placed inside the bag 12' before the bag is folded.

Although the preferred embodiment of the present invention has been shown and described above with respect to the backpack 10 and the shoulder bag 64, the present invention can also be incorporated into many other items which are made of light weight, foldable material, such as a pancho, for example. The wrapping band can be attached near the opening in the poncho, for example, and the body portion can be folded and rolled-up similar to the manner in which the bags 12, 12' of the backpack 10 and the shoulder bag 64 are folded and rolled-up. Thus, in the rolled-up form, with logos or images printed on the front face of the wrapping band, the poncho would also resemble cylindrical products such as beer cans, soda cans, food cans and batteries.

It will be appreciated that a significant advantage of the present invention is that the backpack, the shoulder bag and items such as ponchos can be rolled-up into a compact cylinder form for easy storage. The band for wrapping the bag portion has a face which is adapted for having logos or images printed thereon, so that when rolled-up, the backpack, the shoulder bag and ponchos resemble cylindrical products such as, but not limited to beer cans, soda cans, food cans and batteries.

While particular embodiments of the roll-up carry bag of the invention have been shown and described, it will be appreciated by those skilled in the art that changes and modifications may be made thereto without departing from the invention in its broader aspects and as set forth in the following claims.

What is claimed is:

1. A carry container constructed and adapted to be rolled-up into a compact generally cylindrical shape, comprising:

a bag;

a wrapping band having a front face, a back face, a fixed end and a free end, said back face proximate said fixed end being attached to one of a front and a back of said bag; and fastening means attached to said wrapping band for releasably fastening said free end of said wrapping band to said fixed end of said wrapping band, when said wrapping band is wrapped around said bag after said bag has been rolled-up.

2. The container as defined in claim 1 wherein said wrapping band is attached to one of said front and said back of said bag generally centrally between a first side and a second side of said bag.

3. The container as defined in claim 2 wherein said first and second sides of said bag are gusseted to allow said bag to become generally flat when folded.

4. The container as defined in claim 3 further including a first wing portion extending from a first edge of said wrapping band to said first side of said bag, and a second wing portion extending from a second edge of said wrapping band to said second side of said bag, said first and second wing portions being substantially the same width as a width of said wrapping band, and wherein said first wing portion is adapted to be folded at said first edge of said wrapping band to be generally parallel with said wrapping band, and said second wing portion is adapted to be folded at said second edge of said wrapping band to be also generally parallel with said wrapping band and overlap said first wing portion.

5. The container as defined in claim 4 wherein said fastening means is attached to said front face of said wrapping band proximate said fixed end and to said back face proximate said free end, and after said first and second wing portions are respectively folded at said first and second edges of said wrapping band and rolled-up from a bottom to said top of said bag, said wrapping band is adapted to wrap around said rolled-up bag so that said fastening means attached to said back face fastens to said fastening means attached to said front face.

6. The container as defined in claim 5 wherein said fastening means attached to said back face and said front face together is a hook and loop type fastener.

7. The container as defined in claim 1 further including at least one carrying strap secured to at least one of said front and said back of said bag.

8. The container as defined in claim 7 wherein a first carrying strap has a first end attached proximate a first side of said bag and a second end attached near a second side of said bag on said front of said bag, and a second carrying strap has a first end attached near said first side of said bag and a second end attached near said second side of said bag on said back of said bag.

9. The container as defined in claim 8 further including securing means attached to said front of said bag and adapted to engage fastening means attached to said back face proximate said free end of said wrapping band for releasably securing said free end of said wrapping band to said front of said bag when said bag is not folded.

10. The container as defined in claim 9 wherein said fastening means attached to said free end of said wrapping band and said securing means combine to form a hook and loop type fastener.

11. The container as defined in claim 1 further including a first carrying strap and a second carrying strap attached to one of said front and said back of said bag.

12. The container as defined in claim 11 wherein said first carrying strap has a first end attached proximate a first side of said bag near a top of said back of said bag and a second end attached proximate said first side near a bottom of said back of said bag, and said second carrying strap has a first end attached near said second side of said bag near said top of said back of said bag and a second end attached proximate said second side near said bottom of said back of said bag.

13. The container as defined in claim 12 further including securing means attached to said front of said bag and adapted to engage fastening means attached to said back face proximate said free end of said wrapping band for releasably securing said free end of said wrapping band to said front of said bag when said bag is not folded.

14. The container as defined in claim 13 wherein said fastening means attached to said free end of said wrapping band and said securing means combine to form a hook and loop type fastener.

15. The container as defined in claim 14 wherein said backpack further includes a drawstring looped through said bag proximate said top of said bag for enclosing said top of said bag when said bag is not rolled-up.

16. The container as defined in claim 1 wherein said front face of said wrapping band is adapted to be imprinted with a particular logo so that when said band is wrapped around said bag said logo is visible.

17. Apparatus for maintaining a body made of a flexible and foldable material rolled-up into a compact generally cylindrical shape, comprising:

a wrapping band having a front face, a back face, a fixed end and a free end, said back face proximate said fixed end being attached to one of a front and a back of the body; and fastening means attached to said wrapping band for releasably fastening said free end of said wrapping band to said fixed end of said wrapping band, when said wrapping band is wrapped around the body after the body has been rolled-up.

* * * * *